US006740015B1

(12) United States Patent
Stearns

(10) Patent No.: US 6,740,015 B1
(45) **Date of Patent: *May 25, 2004**

(54) TORSO EXERCISE METHODS AND MACHINES

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

This patent is subject to a terminal disclaimer.

(21) Appl. No.: 10/316,983

(22) Filed: Dec. 9, 2002

Related U.S. Application Data

(63) Continuation of application No. 09/440,239, filed on Nov. 15, 1999, now Pat. No. 6,491,611.

(51) Int. Cl.[7] ..... A63B 26/00

(52) U.S. Cl. ..... 482/142; 297/16.1; 297/445.1; 297/175; 140/129; 140/130; 140/90; 140/121; 140/122; 140/123; 140/124; 446/482

(58) Field of Search ..... 482/142, 140, 482/90, 7–8, 146, 72, 121–24, 129–30; 601/24, 49; 297/16.1, 445.1, 175, 158.4; 404/136; 224/155; 114/363; 4/578.1; 446/482; 280/650

(56) References Cited

U.S. PATENT DOCUMENTS 6,491,611 B1 * 12/2002 Stearns ..... 482/142

* cited by examiner

*Primary Examiner*—Nicholas D. Lucchesi
*Assistant Examiner*—L Amerson

(57) ABSTRACT

A torso exercise machine includes a frame designed to rest upon a floor surface; a seat pivotally mounted on the frame; at least one handlebar pivotally mounted on the frame; and a link pivotally interconnected between the seat and the handlebar. The link constrains the seat and the handlebar to pivot in opposite directions relative to the frame. A resistance device may be interconnected between the handlebar and the frame to resist pivoting of the handlebar and the seat toward one another.

15 Claims, 8 Drawing Sheets

TORSO EXERCISE METHODS AND MACHINES

CROSS REFERENCE TO RELATED APPLICATION

This is a continuation of application serial no. 09/440,239 filed Nov. 15, 1999, now U.S. Pat. No. 6,491,611.

FIELD OF THE INVENTION

The present invention relates to exercise methods and apparatus, and more specifically, to an exercise machine which facilitates exercise of a person's abdominal muscles and/or back muscles while accommodating the person in a sitting position.

BACKGROUND OF THE INVENTION

Those skilled in the art recognize the desirability of exercise, as well as the positive influence of fitness products on people's exercise technique and/or motivation. For example, relatively sophisticated and/or expensive machines have been made for use in clubs, gyms, and the like, to exercise specific muscles or muscle groups. These dedicated machines encourage proper exercise motion and generally provide positive results to people who make use of them. However, because these institutional machines are not available to everyone, a need remains for less complicated and/or less expensive machines which may be acquired for use in the home, but nonetheless provide a satisfactory workout.

SUMMARY OF THE INVENTION

The present invention provides torso exercise machines which are relatively simple in construction, easy to operate, and effective in use. Generally speaking, the machines include a frame designed to rest in a stationary position upon a floor surface; a seat pivotally mounted on the frame and defining a seat pivot axis; and at least one handlebar pivotally mounted on the frame and defining a handlebar pivot axis. A biasing device may be interconnected between the frame and at least one of the handlebar and the seat, to assist or resist pivoting of same relative to the frame.

One aspect of the present invention is to interconnect the seat and the handlebar in such a manner that the seat is constrained to pivot relative to the frame as the handlebar pivots relative to the frame, and vice versa. For example, a linkage may be interconnected between the seat and the handlebar to constrain the seat and the handlebar to pivot in opposite directions relative to one another. The linkage may be optionally disengaged, so that the seat and the handlebar may be operated in an independent mode, as well as a dependent mode. With left and right handlebars disposed on opposite sides of the frame, the decoupling of the seat also frees the handlebars for independent movement relative to one another. Additionally, the seat may be locked against pivoting relative to the frame when the handlebars are free to undergo independent movement.

Additional aspects of the present invention are to position the seat pivot axis at a distance apart from the handlebar pivot axis; position the seat pivot axis to extend beneath the seat; position the seat pivot axis to bisect the planform of the seat; position the handlebar pivot axis to extend beneath the seat; position the handlebar pivot axis to extend rearward of the planform of the seat; and/or position the handlebar pivot axis to be lower to the floor than the seat pivot axis. Still more features and/or advantages of the present invention may become apparent from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of a first exercise machine constructed according to the principles of the present invention;

DETAILED DESCRIPTION OF THE PREFERRED EMBODIMENT

Figure 1:
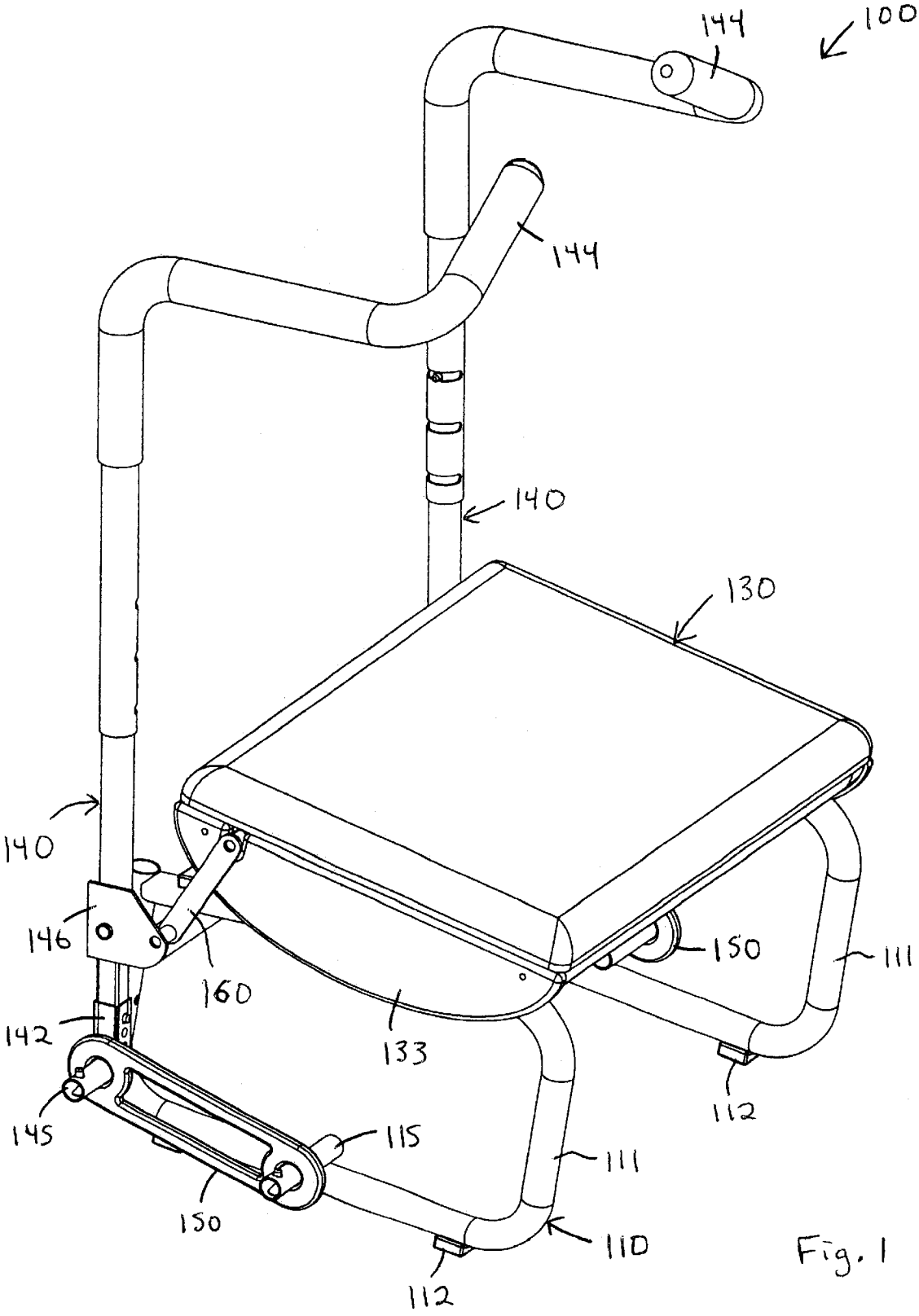
Figure 2:
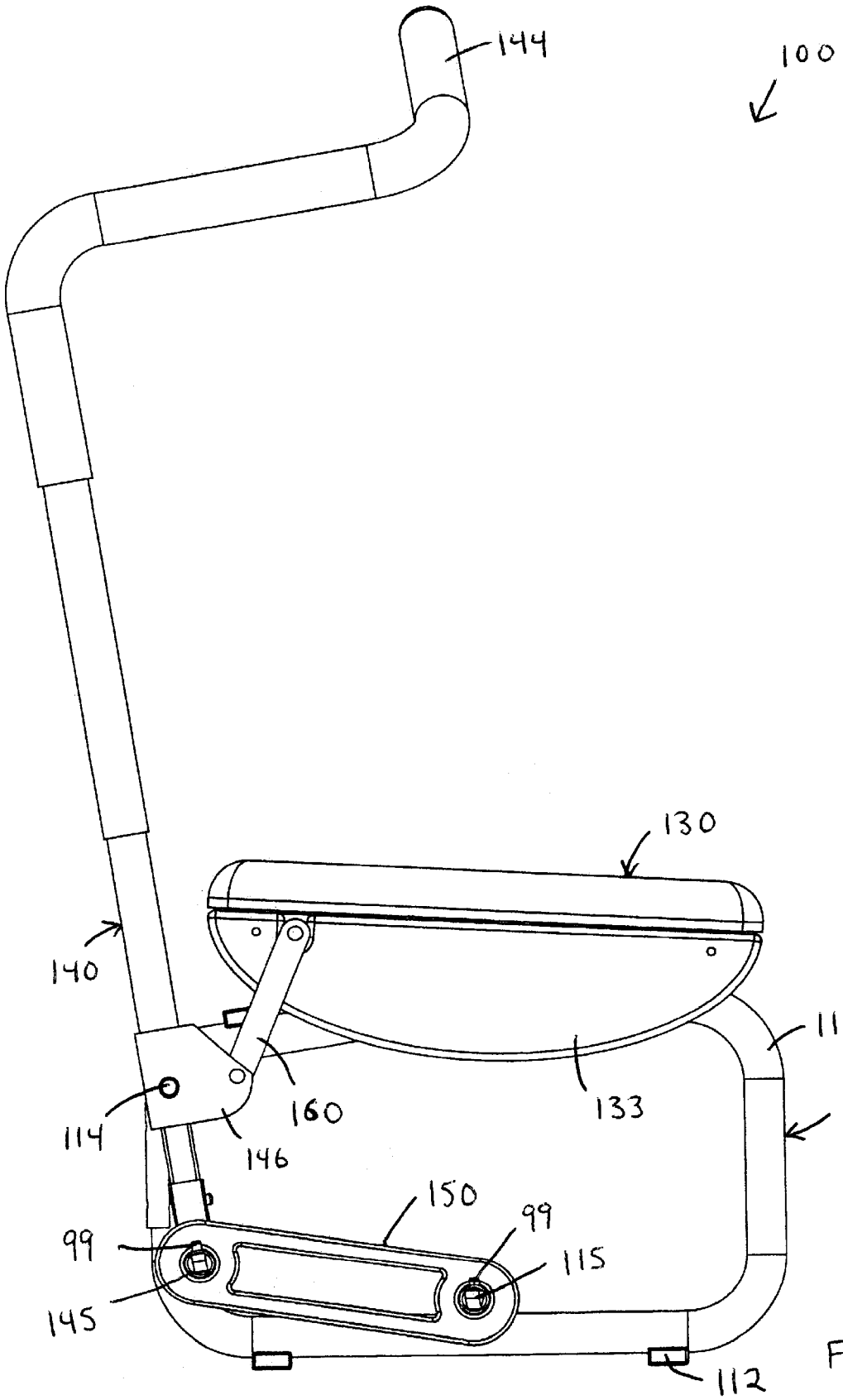
FIG. 2 is a side view of the exercise machine of FIG. 1.

A first exercise apparatus constructed according to the principles of the present invention is designated as 100 in FIGS. 1–7. The exercise apparatus 100 generally includes a frame 110; a seat 130 pivotally mounted on the frame 110; left and right handlebars 140 pivotally mounted on the frame 110; left and right resistance devices 150 interconnected between the frame 110 and respective handlebars 140; and left and right connector links 160 pivotally interconnected between the seat 130 and respective handlebars 140.

The frame 110 includes left and right side members 111, each of which is a round steel tube bent into a generally rectangular configuration. A transverse member 119, having a generally H-shaped configuration, is rigidly secured between the side members 111 at the rearward end of the apparatus 100. Rubber pads or feet 112 are secured underneath the side members 111 to engage an underlying floor surface. The feet 112 tend to maintain the apparatus 100 in a stationary position relative to the floor surface, while also reducing the likelihood of damage to the floor surface. Left and right trunnions 113 are mounted on top of respective side members 111 to support the seat 130, as further explained below. Also, rubber pads or bumpers 121 and 122 (which may be similar to the pads 112 to achieve economies of scale) are mounted on top of the side members 111, proximate the forward end of the apparatus 100 and the rearward end of the apparatus 100, respectively.

The seat 130 includes an upwardly facing cushion 131 and an underlying rigid base 132. The base 132 is made of steel tubes that are secured together into a rectangular configuration. Opposite sides of the base 132 are pivotally mounted on respective trunnions 113 by means of bolts or other suitable fasteners. As a result of this arrangement, the seat 130 pivots about a seat pivot axis relative to the frame 110. The seat pivot axis is disposed beneath the seat and is both coaxial with the bolts and co-planar with a plane extending perpendicularly through the center of the seat 130. The forward bumpers 121 absorb impact associated with the forward end of the seat 130 pivoting downward into contact with the frame 110, and the rearward bumpers 122 absorb impact associated with the rearward end of the seat 130 pivoting downward into contact with the frame 110. A respective shield 133 is mounted on each side of the seat 130 to cover the trunnions 113 and reduce potential pinch point problems associated with pivoting of the seat 130 relative to the frame 110.

Each of the handlebars 140 includes an intermediate portion that is rotatably mounted on a respective side member 111 by means of a respective bolt 114 or other suitable fastener. As a result of this arrangement, each handlebar 140 pivots about a common handlebar pivot axis relative to the frame 110. The handlebar pivot axis extends parallel to the seat pivot axis and is coaxial with the bolts 114. The handlebar pivot axis is disposed rearward of the seat 130 and beneath both the seat 130 and the seat pivot axis. Each intermediate portion includes a lower square tube segment 141 and an upper round tube segment 147 which are secured together by welding or other suitable means.

A respective connector plate 146 is secured to the intermediate portion of each handlebar 140 by welding or other suitable means, spanning the juncture between a respective square tube segment 141 and a respective round tube segment 147. A rigid left connector link 160 is pivotally interconnected between the left connector plate 146 and the left side member 111, and a rigid right connector link 160 is similarly pivotally interconnected between the right connector plate 146 and the right side member 111. The associated pin joints are designated as 163 and 164 in FIG. 5. The pin joints 164 are spaced radially apart from the bolts 114 (and the handlebar pivot axis).

Figure 3:
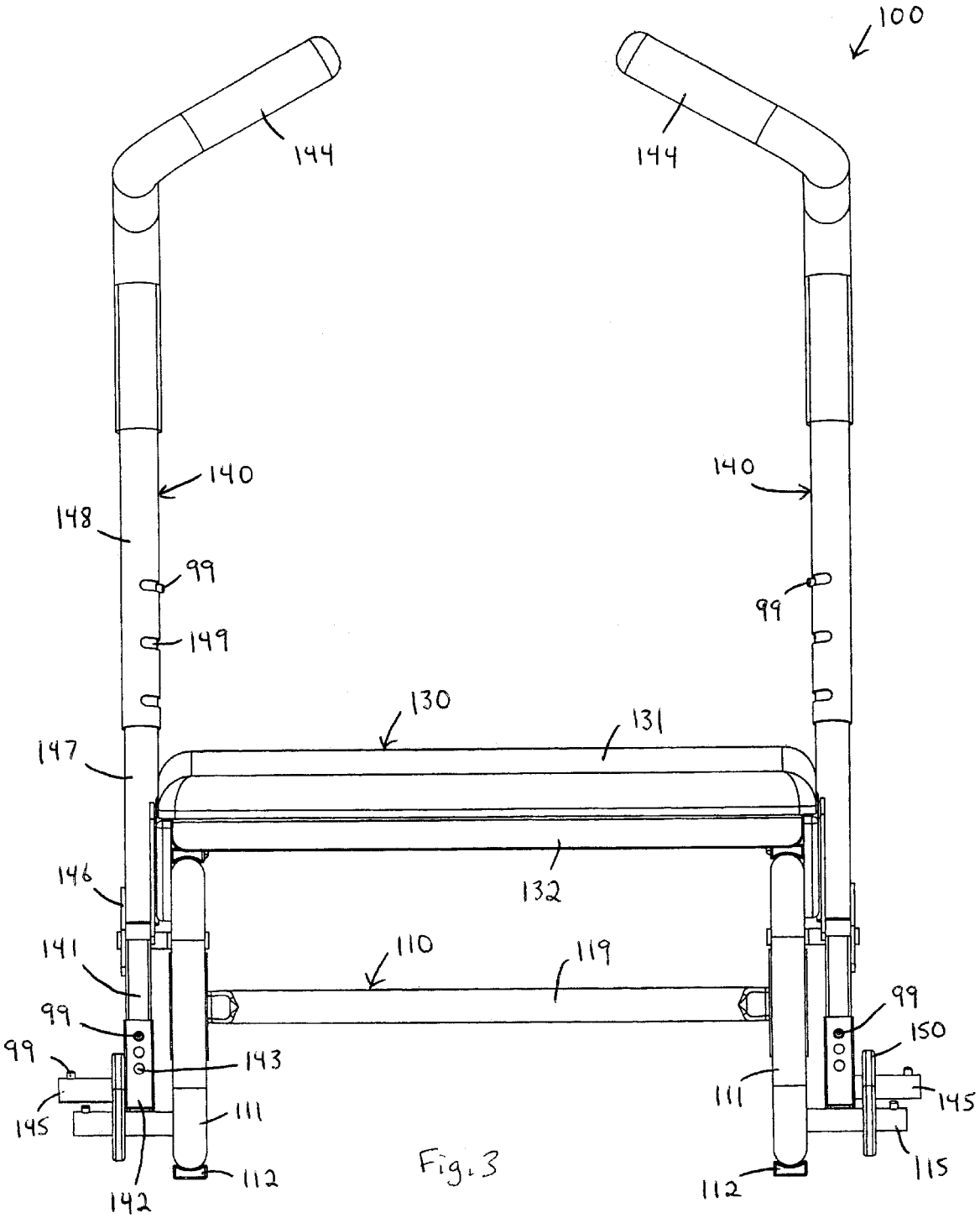
FIG. 3 is a front view of the exercise machine of FIG. 1.
Figure 4:
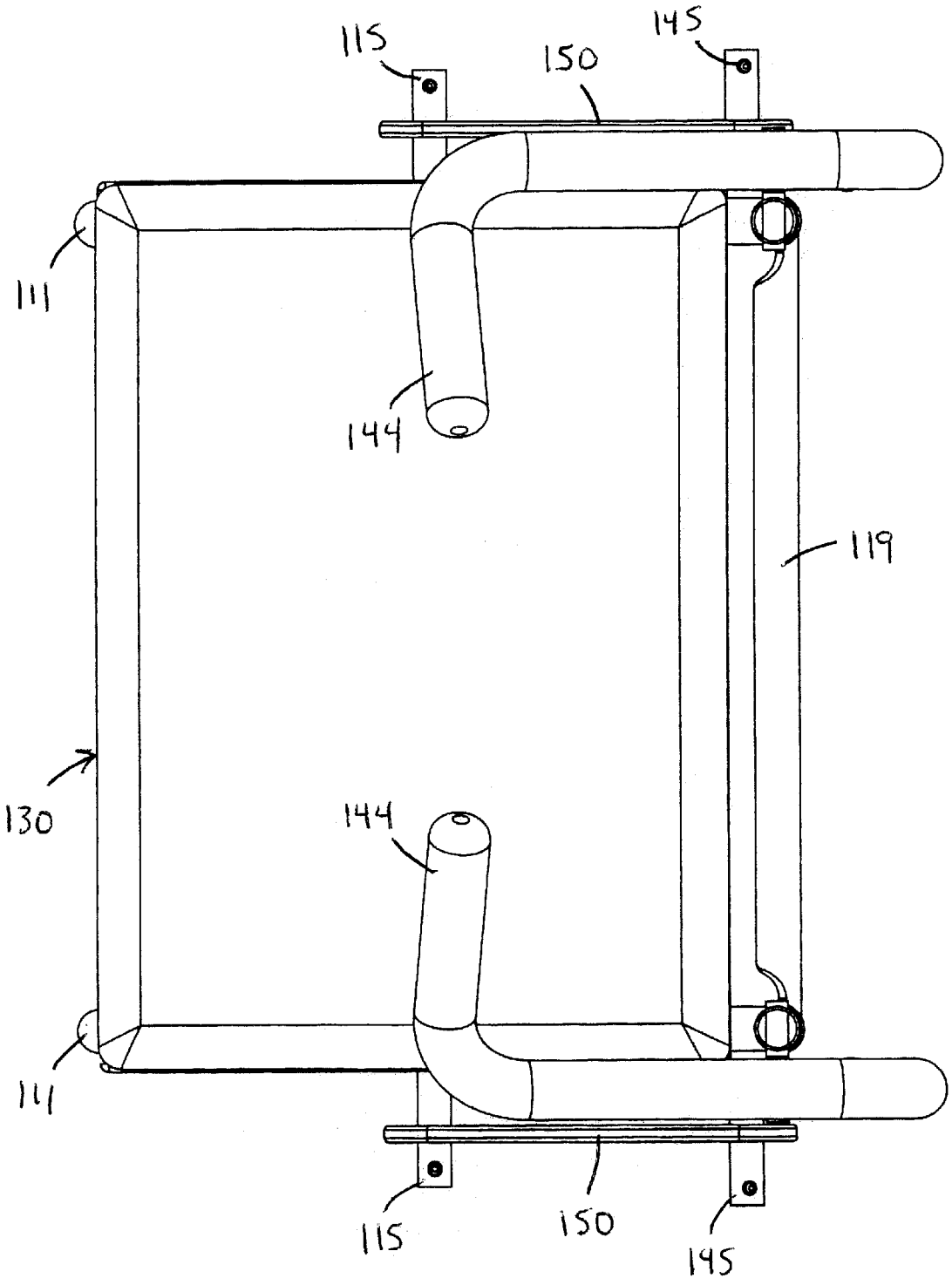
FIG. 4 is a top view of the exercise machine of FIG. 1.
Figure 5:
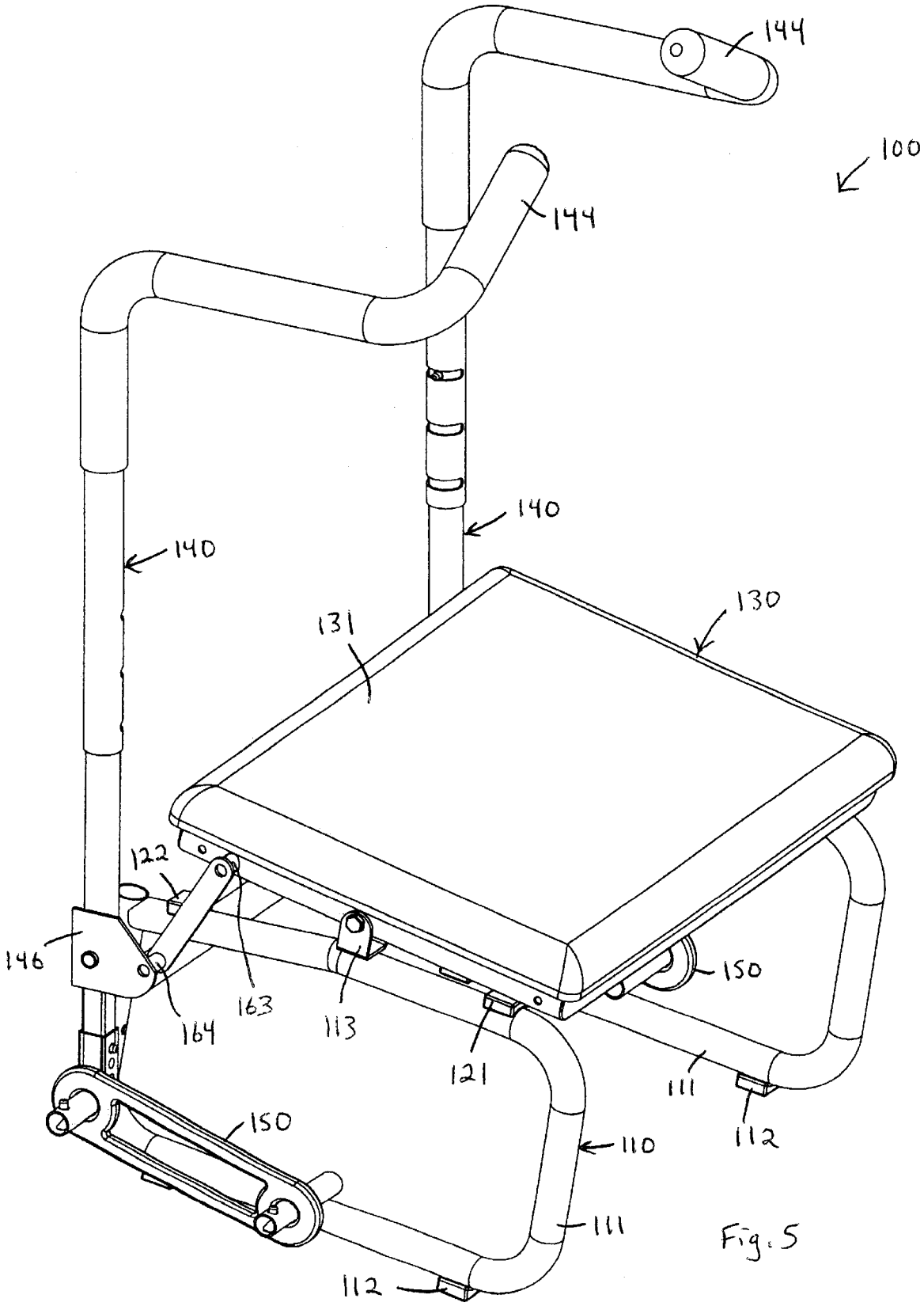
FIG. 5 is a perspective view of the exercise machine of FIG. 1, shown with a protective panel removed.

Each handlebar 140 also includes a lower distal portion 142 which is a square tube sized and configured to fit over a respective square tube segment 141 in telescoping fashion. As shown in FIG. 3, several holes 143 extend through the forward side of each tube 142 and alternately align with a comparable hole through the forward side of a respective segment 141. A snap button 99 is disposed inside each square tube segment 141 and projects through the hole in the segment 141 and any aligned hole 143 in a respective end portion 142. As a result of this arrangement, the end portion 142 may be adjusted radially relative to the handlebar pivot axis.

Tubular supports 145 project laterally outward from respective end portions 142 to support the rearward ends of respective resistance devices 150. The forward ends of the resistance devices 150 are secured to similar supports 115 on respective side members 111. The supports 115 and 145 are rigidly secured in their respective places by welding or other suitable means. Snap buttons 99 are disposed inside respective supports 115 and 145 and project through upwardly opening holes in same. The snap buttons 99 releasably retain the ends of respective resistance devices 150 in place on respective supports 115 and 145.

Each resistance device 150 is a conventional band of elastic material having annular ends and tangential strips extending therebetween. The supports 115 and 145 may be configured to support more than one such device 150 on each side of the apparatus 100, in the event that additional resistance force is desired. Those skilled in the art will also recognize that other known resistance devices (or assisting devices) may be used in place of and/or together with the elastic members 150 without departing from the scope of the present invention.

Figure 7:
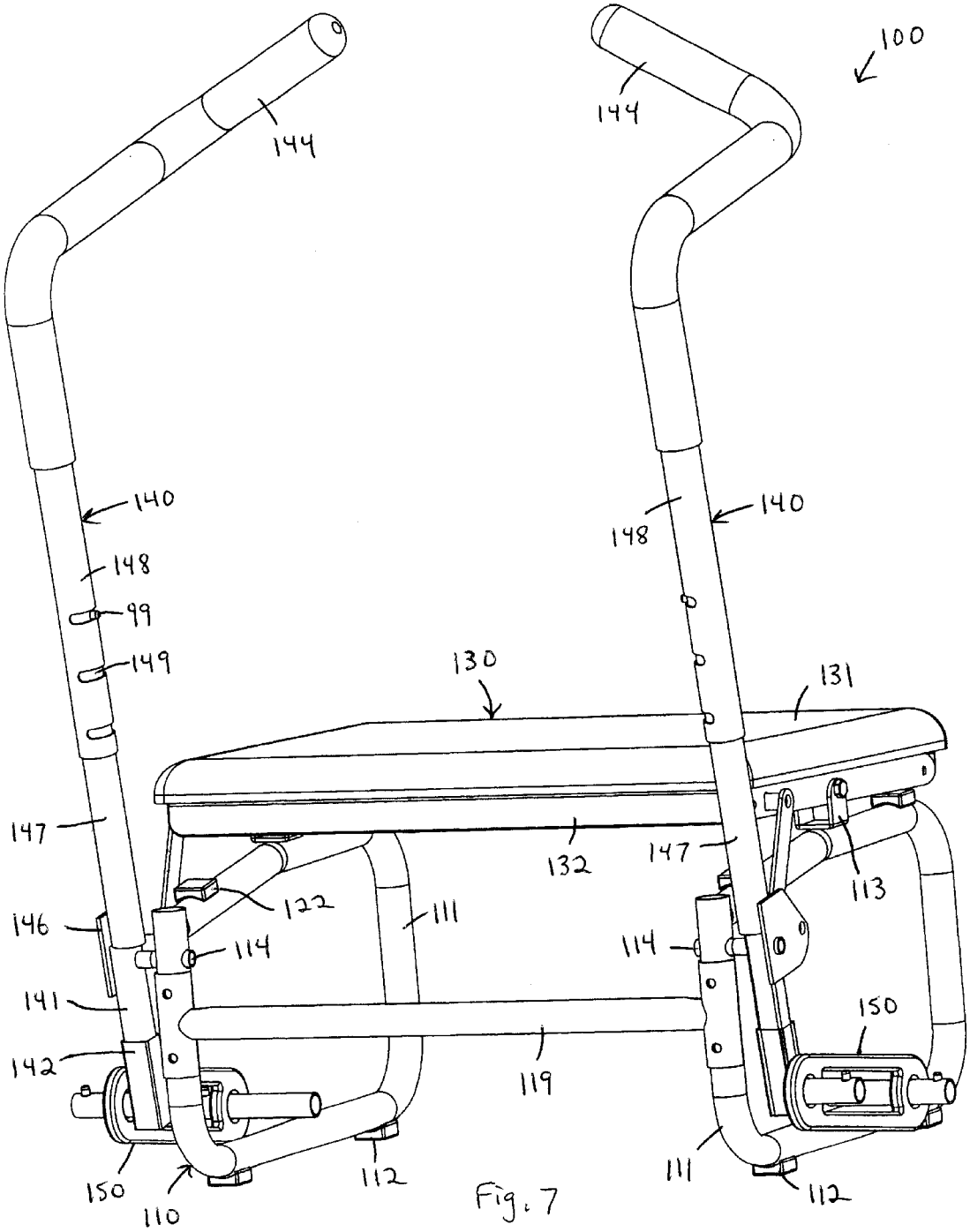
FIG. 7 is another perspective view of the exercise machine of FIG. 5, shown from a generally rearward perspective.

Each handlebar 140 further includes an upper distal portion 148 which is a round tube sized and configured to fit over a respective round tube segment 147 in telescoping fashion. As shown in FIG. 7, several openings 149 are provided in each upper distal portion 148 and alternately align with a comparable hole through a respective segment 147. A snap button 99 is disposed inside each round tube segment 147 and projects through the hole in the segment 147 and any aligned opening 149 in a respective end portion 148. As a result of this arrangement, the upper end portion 148 may be adjusted radially relative to the handlebar pivot axis.

Each of the upper distal portions 148 is also rotatably mounted on a respective segment 147. The extent of rotation is limited by travel of the snap buttons 99 within respective openings 149. In this regard, the openings 149 are circumferential slots, and the upper distal portions 148 are free to rotate relative to respective segments 147 until the snap buttons 99 engage the ends of respective slots 149. When the snap buttons 99 are centered in respective slots 149, each end portion 148 extends axially away from a respective intermediate portion, then forward to a respective handle 144 which extends upward and toward an opposite side of the apparatus 100. Those skilled in the art will recognize that the arm portions 148 and/or segments 147 may be replaced by other conventional force receiving members without departing from the scope of the present invention.

Figure 6:
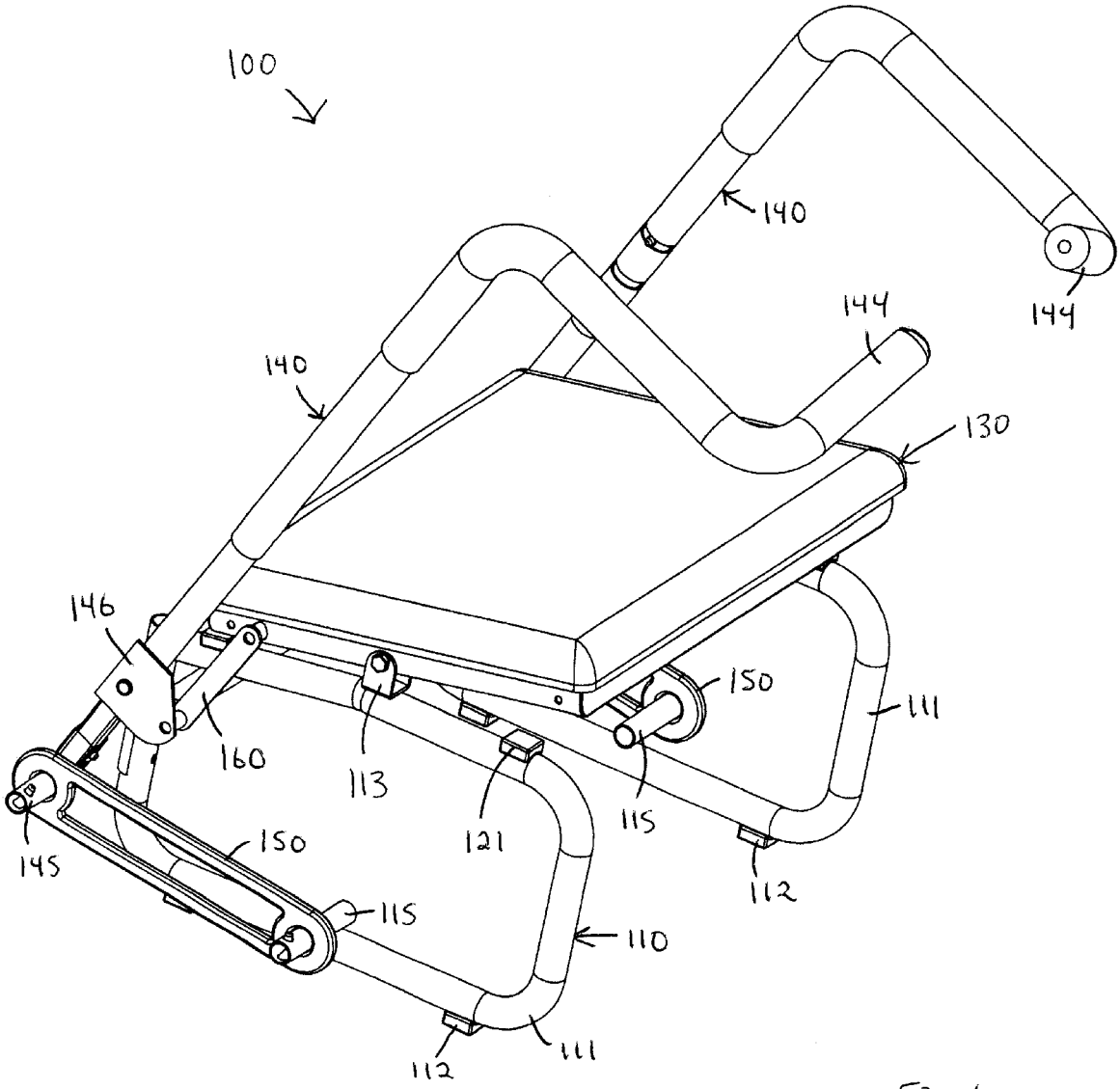
FIG. 6 is a perspective view of the exercise machine of FIG. 5, shown at a discrete point in an exercise cycle.

To operate the apparatus 100 for abdominal exercise purposes, a person sits on the seat 130 and faces forward (with his/her knees relatively closer to the front bumpers 121 than the rear bumpers 122). In the absence of user applied force, the handlebars 140 tend to occupy the respective positions shown in FIG. 5 (with the seat 130 tilted forward into contact with the bumpers 121. As the person presses forward against the handlebars 140, preferably with a respective handle 144 grasped in each hand, the handlebars 140 and the seat 130 pivot toward one another, as shown in FIG. 6. The resistance bands 150 stretch in response to this movement, thereby providing resistance to the movement and encouraging the handlebars 140 and the seat 130 to return to the respective positions shown in FIG. 5.

The upper distal portions 148 may be adjusted relative to the handlebar pivot axis to accommodate people of different sizes, and/or the lower distal portions 142 may be adjusted relative to the handlebar pivot axis to provide different levels of resistance. To operate the apparatus 100 for back exercise purposes, the person goes through a similar procedure while sitting on the seat 130 and facing the opposite direction.

The preferred embodiment 100 strikes a desirable balance between the cost of manufacture, the ease of use, and the results of use. The linkage assembly defined by and among the frame 110, the seat 130, the handlebars 140, and the links 160 provides a natural feeling exercise motion which is conducive for exercising the upper abdominal muscles and/or the lower abdominal muscles. The machine 100 is easy to mount and dismount, as well.

Although the present invention has been described with reference to a particular embodiment, those skilled in the art will recognize additional embodiments and/or applications which incorporate the essence of the present invention. For example, the rigid links 160 may be replaced by cable arrangements which may optionally be configured to impose a force ratio between handle movement and seat movement. Also, the links 160 may be selectively rendered inoperative to allow independent motion of the handlebars 140 relative to the seat 130 and the frame 110, as well as one another, thereby allowing a person to exercise his/her oblique muscles. In this regard, the pins 164 may be spring detent pins which are selectively removable, in which case the loose end of each link 160 may be secured to the seat 130

(for an independent movement mode), or the loose end of each link 160 may be secured to the frame 110 (for a stationary seat mode). The seat 130 may alternatively be locked in place by inserting one or more fasteners through aligned holes in one or more frame members 111 and covers 133.

Figure 8:
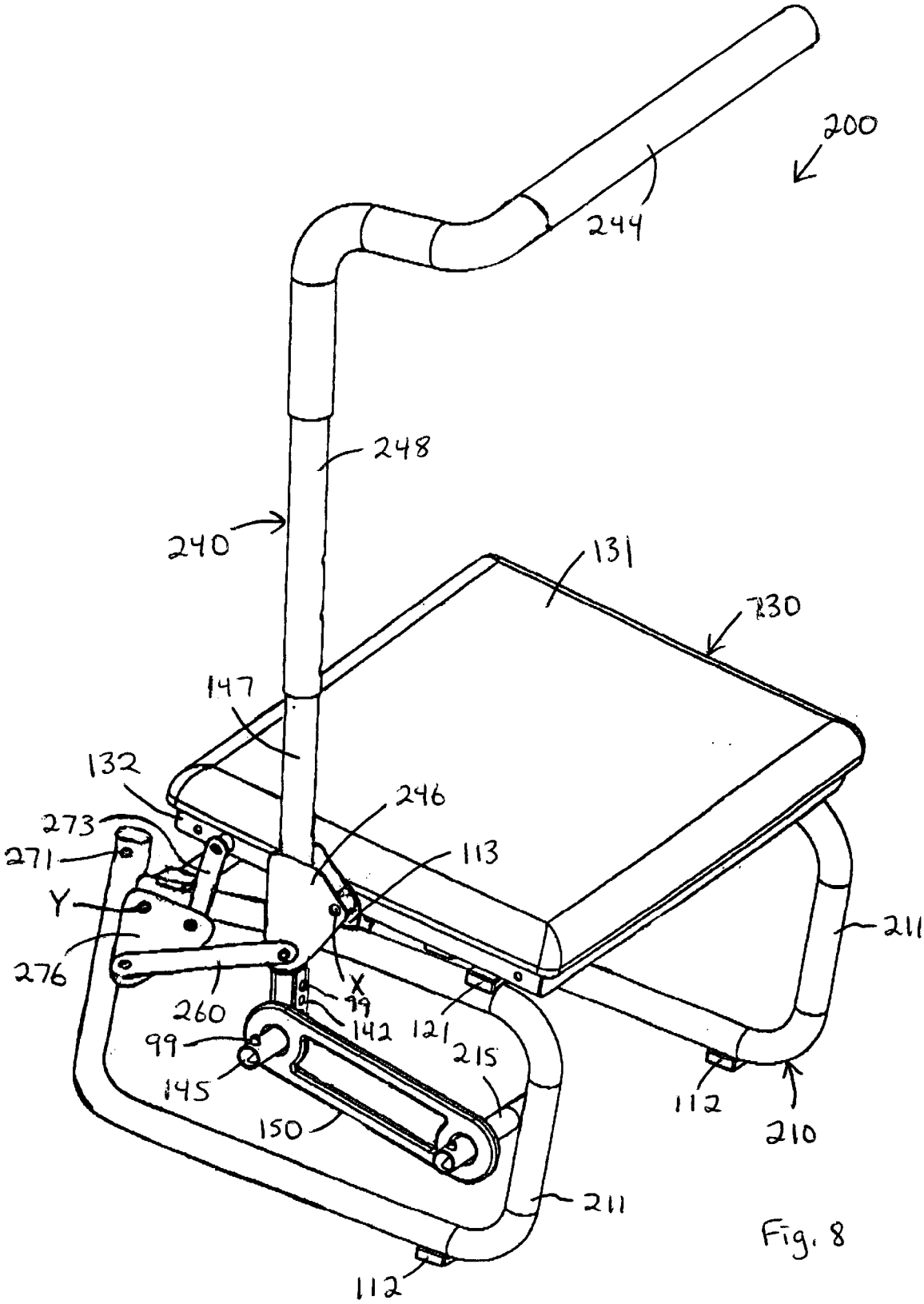
FIG. 8 is a perspective view of a second exercise machine constructed according to the principles of the present invention.

In order to illustrate some of the many possible variations that may be incorporated into the present invention, FIG. 8 shows a second exercise apparatus 200 which is constructed according to the principles of the present invention. The apparatus 200 generally includes a frame 210; a seat 230 pivotally mounted on the frame 210; a single handlebar 240 pivotally mounted on the frame 210; a resistance device 150 interconnected between the frame 210 and the handlebar 240; and a linkage pivotally interconnected between the seat 230 and the handlebar 240.

The frame 210 is similar to the frame 110 except for the locations of holes for fasteners and the upwardly extending segment(s) at the rear of the apparatus 200. In this regard, at least one of the side members 211 terminates in an upwardly extending end segment which is provided with a fastener receiving hole 271. The seat 230 is similar to the seat 130 except that the covers 133 have been eliminated.

The handlebar 240 is pivotally mounted on the frame 210 at the right side trunnion 113 together with the seat 230. More specifically, an intermediate portion of the handlebar 240 is secured inside a bracket 246 having a U-shaped profile, and the bracket 246 is pivotally connected to the trunnion 113 by a bolt or other suitable means. As a result of this arrangement, the handlebar 240 and the seat 230 pivot about a common pivot axis X.

The bracket 246 covers a juncture between members 147 and 141 similar to those on the first embodiment 100. A lower distal end 142 is slidably mounted over the member 141 and releasably secured in place by a snap button 99, in the same manner as on the first embodiment 100. A tubular support 145 projects laterally outward from the lower distal end 142 to support the rear end of the resistance device 150. Another tubular support 215 projects laterally outward from the right side member 211 to support the front end of the resistance device 150. The supports 145 and 215 are secured in their respective places by welding or other suitable means. Snap buttons 99 are disposed inside the supports 145 and 215 to releasably secure the ends of the conventional elastic band 150 in place.

As on the first embodiment 100, an upper distal end 248 is slidably mounted over the member 147 and releasably secured in place by a snap button. The upper distal end 248 terminates in a laterally extending member 244 which is sized and configured to span a person's chest. This particular arrangement is shown on the second embodiment 200 to emphasize that the present invention may be implemented with one handlebar 240 or two handlebars 140.

A connector plate 276 is pivotally mounted on the frame 210 and pivots about a pivot axis Y. A first connector link 260 is pivotally interconnected between a lower portion of the connector plate 276 and a lower portion of the handlebar bracket 246. A second connector link 273 is pivotally interconnected between a forward portion of the connector plate 276 and a rearward portion of the seat frame 132. As a result of these interconnections, the seat 230 and the handlebar 240 are constrained to pivot in opposite directions relative to the frame 210. A removable pin is used to interconnect the second connector link 273 and the connector plate 276, so that in the alternative, the second connector link 273 may be interconnected between the seat 230 and the frame 210 (at hole 271). In this alternative configuration, the seat 230 remains stationary, and the handlebar 240 is pivotal relative to both the frame 210 and the seat 230.

Recognizing that the present invention is not strictly limited to the specific embodiments and applications disclosed herein, the scope of the present invention is to be limited only to the extent of the following claims.

What is claimed is:

1. An exercise apparatus, comprising:

a frame configured to rest on a floor surface;

a seat pivotally mounted on the frame for pivoting about a seat pivot axis that is fixed in place on the frame at a location underlying an intermediate portion of the seat; and a linkage, wherein the linkage includes a handlebar, and the linkage is interconnected between the seat and the frame in a manner that constrains the seat and the handlebar to pivot in opposite rotational directions.

2. The exercise apparatus of claim 1, further comprising a resistance device configured and arranged to resist pivoting of the seat and the handlebar toward one another.

3. The exercise apparatus of claim 1, wherein the handlebar includes a hand grip portion that overlies the seat when a person is at rest on the apparatus.

4. The exercise apparatus of claim 1, wherein the handlebar pivots about the seat pivot axis.

5. The exercise apparatus of claim 1, wherein the handlebar pivots about an axis that underlies the seat.

6. An exercise apparatus, comprising:

a frame configured to rest on a floor surface;

a seat configured and arranged to define a seat pivot axis beneath an intermediate portion of the seat;

a handlebar; and at least one link, wherein the seat, the handlebar, and the at least one link are movably interconnected to one another and the frame in a manner that constrains the seat and the handlebar to pivot in opposite rotational directions.

7. The exercise apparatus of claim 6, further comprising a resistance device configured and arranged to resist pivoting of the seat and the handlebar toward one another.

8. The exercise apparatus of claim 6, wherein both the seat and the handlebar pivot about the seat pivot axis.

9. The exercise apparatus of claim 6, wherein the handlebar pivots about an axis that underlies the seat.

10. An exercise apparatus, comprising:

a frame configured to rest on a floor surface;

a seat having a front edge, and pivotally mounted on the frame at a location behind the front edge;

a handlebar having an upper end, and pivotally mounted on the frame at a location beneath the upper end;

a connector member having a first portion pivotally mounted on the frame, and a radially displaced second portion movably connected to the seat in a manner that accommodates pivoting of the seat and the connector member about discrete pivot axes; and a link pivotally interconnected between the handlebar and a radially displaced third portion of the connector member in a manner that constrains the front edge of the seat to pivot toward the upper end of the handlebar in response to pivoting of the upper end of the handlebar toward the front edge of the seat.

11. The exercise apparatus of claim 10, wherein the connector member is disposed beneath the seat.

12. The exercise apparatus of claim 11, wherein the link is disposed beneath the seat.

13. The exercise apparatus of claim 12, wherein the link is connected to the handlebar at a location beneath a pivot axis defined by pivoting of the handlebar relative to the frame.

14. The exercise apparatus of claim 13, wherein the pivot axis is disposed higher above the floor surface than another pivot axis defined by pivoting of the connector member relative to the frame.

15. The exercise apparatus of claim 10, wherein the discrete pivot axes include a first pivot axis defined by pivoting of the connector member relative to the frame, and a second, relatively higher pivot axis defined by pivoting of the seat relative to the frame.

* * * * *